United States Patent [19]

Silverman et al.

[11] 4,144,794

[45] Mar. 20, 1979

[54] DEVICE FOR AND METHOD OF REMOVABLY SECURING A HARNESS TO A MUSICAL INSTRUMENT

[76] Inventors: Allen B. Silverman, 100 Eldrige St., Mill Valley, Calif. 94941; Donald O. Collins, 15 Fountain, San Francisco, Calif. 94114

[21] Appl. No.: 903,684

[22] Filed: Jun. 9, 1978

[51] Int. Cl.[2] ..... G10G 5/00

[52] U.S. Cl. ..... 84/327; 24/211 N; 224/1 A; 224/257; 224/5 S

[58] Field of Search ..... 24/211 R, 211 M; 84/327, 453; 224/1 A, 5 S

[56] References Cited

U.S. PATENT DOCUMENTS

| | | | |
|---|---|---|---|
| 1,647,783 | 11/1927 | Carr | 24/211 L |
| 2,480,662 | 8/1949 | McKinzie | 24/211 N |
| 3,302,507 | 2/1967 | Fender | 84/327 X |
| 4,028,981 | 6/1977 | Cravens | 84/327 |

*Primary Examiner*—Lawrence R. Franklin
*Attorney, Agent, or Firm*—Robert Charles Hill

[57] ABSTRACT

A device for securing a harness to a musical instrument such as a guitar is provided with a receptacle assembly on the musical instrument and a pin member attached to a harness. Means selectively engage a projecting portion of the pin member within a chamber of the receptacle assembly and allow for rotatable movement therebetween.

4 Claims, 3 Drawing Figures

DEVICE FOR AND METHOD OF REMOVABLY SECURING A HARNESS TO A MUSICAL INSTRUMENT

SUMMARY OF THE INVENTION

The present invention relates to a structure for and method of removably securing a harness to a musical instrument. A device for securing a harness to a musical instrument selectively engages a pin member attached to a harness within a receptacle assembly on the musical instrument. The harness is intermediate two enlarged members which in turn are held in place by a flange and retaining clip, respectively.

BACKGROUND OF THE INVENTION

Stringed musical instrument plucked with the fingers such as guitars, banjos and mandolins continue to have widespread acceptance as an enjoyable form of musical recreation. Musical players range in age from the young to the elderly and guitars, etc., continue to be produced in record numbers. Latest figures indicate that approximately one and one-half million guitars, electric guitars, banjos, electric basses, ukuleles and mandolins are sold in the United States on a yearly basis. The guitar is now the second most popular instrument in the country and is played by almost eleven million amateurs as well as thousands of professional musicians.

All of the above-named stringed musical instruments require that a harness or strap be secured to the instrument and looped over the neck of the player to position the instrument while it is being played. Curiously enough, there is no known commercially available device suitable for quickly securing a harness to the above musical instruments in a foolproof manner while at the same time allowing the harness adequate movement relative to the instrument.

Careful analysis of the problems encountered with the existing securing devices led to the conclusion that the ideal device for securing a harness to a musical instrument should be absolutely secure, have a quick release, contain no loose parts, not wear the strap or hanger, be suitable for one handed operation and provide swivel movement between the harness and instrument. Unfortunately, as will be seen below, none of the prior art devices possesses all of these desired attributes.

One popular manner of harness attachment uses a button-shaped knob which is screwed into the body of the musical instrument and over which is positioned the slit in the harness. Because the knob has to be small enough for the slit to fit over it, there is always some looseness in this arrangement which oftentimes results in the ever present problem of the instrument falling off its strap, thereby resulting in many broken guitars and basses and leaving the player with diminished confidence and peace of mind.

Another attachment method utilizes a threaded post screwed into the instrument body onto which is rotated a large nut to maintain the harness. This method is time consuming and sometimes results in loss of the nut which causes unwanted frustration and anxiety. Additionally, the threads of the post tend to cut and wear the harness and enlarge the slit therein.

A relatively new connecting device, U.S. Pat. No. 4,028,981, has a button-shaped knob riveted into a mini-strap which in turn is attached to the instrument body by screws. The knob then is inserted into the harness slit. While this device does not damage the harness, it is not absolutely secure and tends to be bulky and cumbersome.

Other U.S. patents of interest are U.S. Pat. Nos. 2,480,662 and 3,302,507.

The present invention eliminates all of the problems inherent in the above described devices. The present invention is absolutely secure with a positive locking engagement, has a quick release by merely depressing a spring loaded member, contains no loose parts, has no sharp wearing edges, is suitable for one handed operation because of a snap lock arrangement, and allows swivel movement between the harness and the instrument because of the rotatable movement between the projecting portion and the chamber.

OBJECTS OF THE INVENTION

It is the primary object of the present invention to provide a new and improved device for and method of removably securing a harness to a musical instrument.

Another object is to provide a securing device which can be attached to a new musical instrument or can be used to replace existing unsatisfactory devices on used instruments.

A further object is to provide structure which is inexpensive to manufacture and long lasting in usage.

DESCRIPTION OF THE PREFERRED EMBODIMENT

Figure 3:
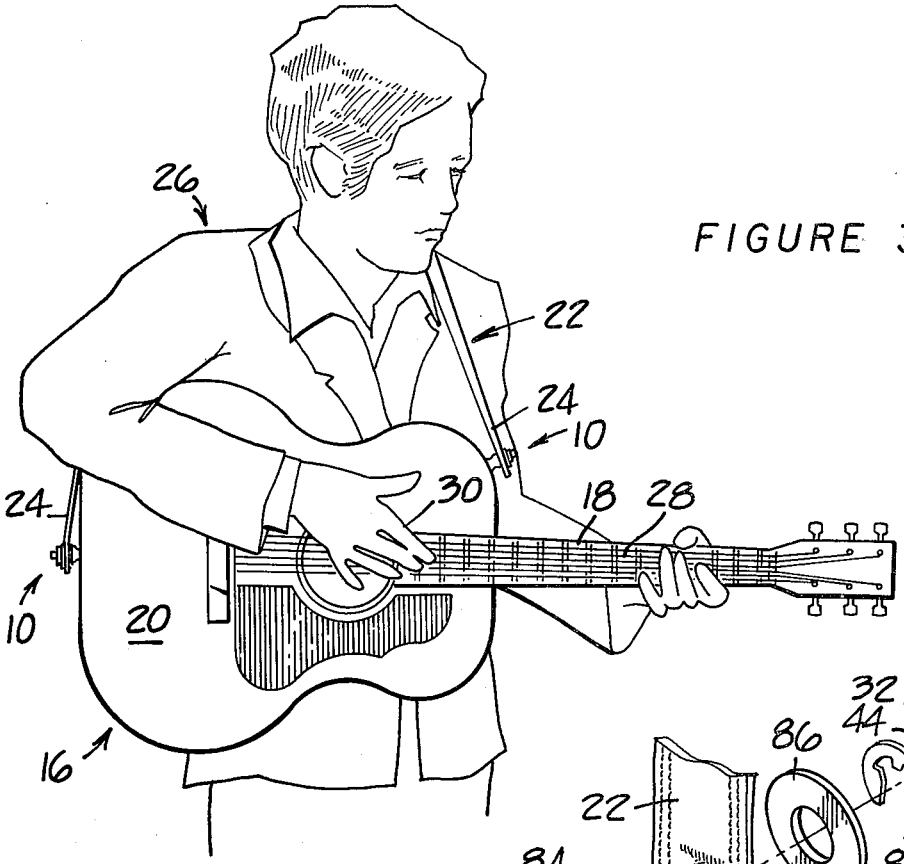
FIG. 3 illustrates two securing devices in operation on a musical instrument.
Figure 1:
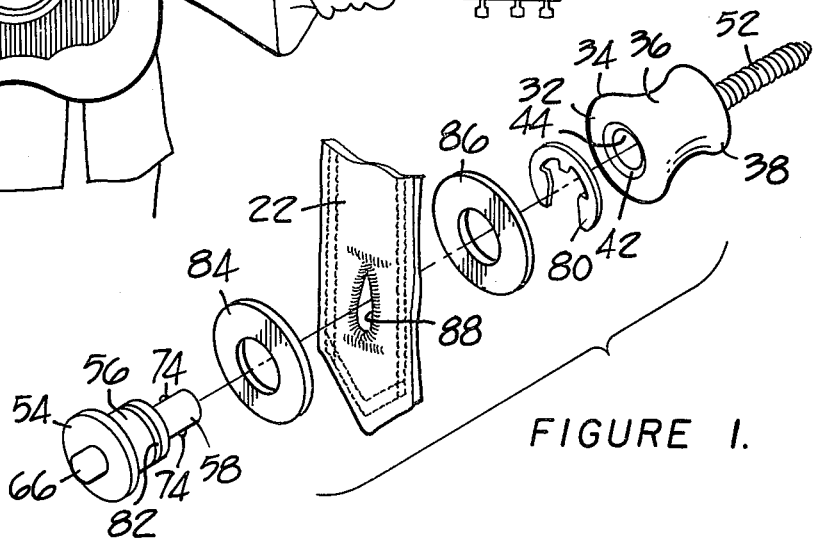
FIG. 1 is a perspective view of the securing device of the present invention showing the receptacle assembly, an end portion of the harness and the pin member in a spaced apart relationship.
Figure 2:
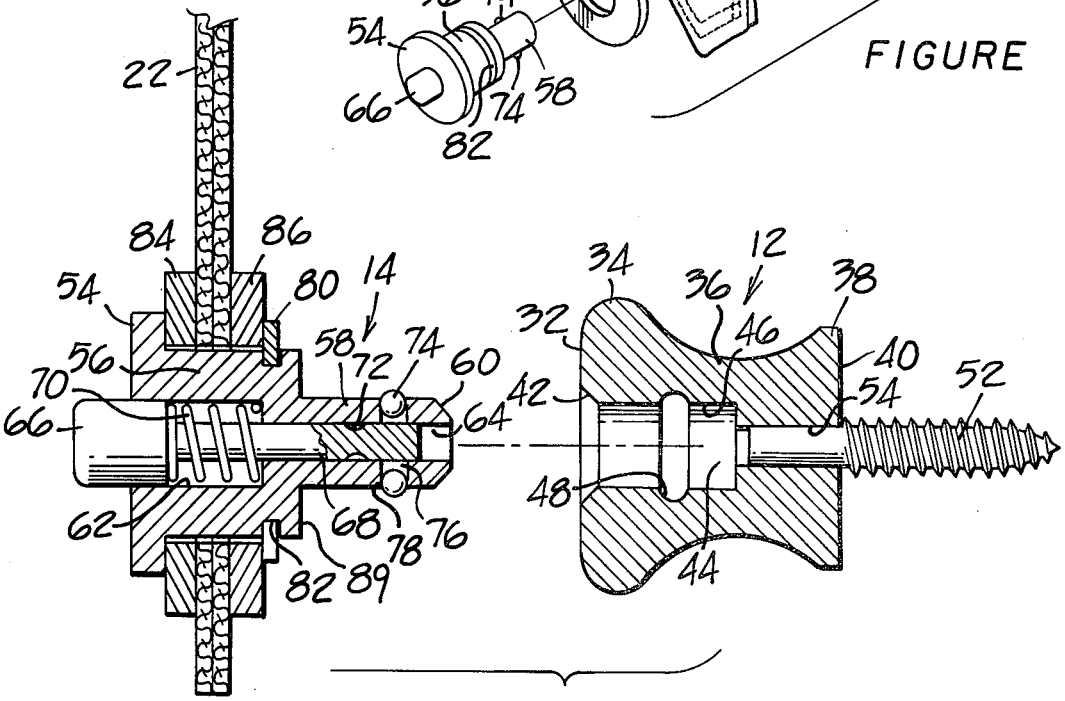
FIG. 2 is an enlarged sectional view of the pin member and receptacle assembly.

Referring to FIGS. 1 through 3 which illustrate the device for securing a harness to a musical instrument of the present invention, the securing device generally indicated 10 (FIG. 3) has a receptacle assembly generally indicated 12 (FIG. 2) and a pin member generally indicated 14 (FIG. 2). The receptacle assembly 12 is attached to the musical instrument generally indicated 16 near the neck 18 thereof and also in the middle bottom 20 of the body. The pin member 14 is attached to the harness or strap generally indicated 22 at the two slit or buttonhole-like portions at each end 24. The harness 22 is looped over the neck of the player generally indicated 26 and is of such a length to position the musical instrument 16 at the proper height while the strings 28 are plucked by the fingers 30.

The receptacle assembly 12 is somewhat hourglass in shape and has a level top surface 32, a rounded upper portion 34, a narrow middle portion 36, an expanding lower portion 38 and a level bottom surface 40. The assembly 12 is a solid body of material cored out at the upper portion 34 to form a tapered entranceway 42 leading to an annular chamber 44 which is surrounded by a circular wall 46. Down into the chamber 44 and preferably about midway therein is interior annular groove 48. A slot (not shown) may be provided to interrupt top surface 32 and extend into the upper portion 34 past the tapered entranceway 42.

Screw member 52 extends beyond bottom surface 40 and is the means whereby the assembly 12 is attached to the musical instrument 16. Screw member 52 is secured to the assembly 12 by conventional means such as by a press fit into aperture 54 or by threads. Additionally, screw member 52 can be oversized to ensure positive connection to the musical instrument 16 even if the outdated button-shaped knob discussed above has pulled out or its screw hole is worn. If desired, aperture 54 can be tapered, screw member 52 eliminated, and a regular screw (not shown) inserted into aperture 54, with the head thereof retained within aperture 54 and the screw portion extending beyond bottom surface 40 much like screw member 52.

A variation of the present invention is to eliminate the lower portion 38 and bottom surface 40 of the assembly 12 and to have in place thereof a lower cone shaped portion having external threads thereon. In this manner the entire assembly 12 could be screwed into the musical instrument until level top surface 32 would be flush therewith. In either form, the assembly 12 can be sized to accommodate the heretofore normal modes of harness attachment.

The pin member 14 has a flange portion 54, a central portion 56 and a shank or projecting portion 58 terminating in slanted edge 60 which is compatible with tapered entranceway 42 on the receptacle assembly 12. As shown in FIG. 2 both slanted edge 60 and tapered entranceway 42 are at 45° angles. While these angles may vary, best results occur when both angles total 90°.

The pin member 14, like the assembly 12, is a solid body of material, such as metal or the like with a highly polished finish, cored out therethrough to form an upper chamber 62 and a lower chamber or axially disposed cavity 64. Button member 66 having finger 68 fits within the chambers 62 and 64. Spring 70 encircles finger 68, is attached to shank 56 and button 66, and is biased upward to position button 66 outward of flange 54 while at the same time retaining button 66 and finger 68 within the chambers 62 and 64, respectively. Ball socket 72 is notched out of finger 68 to receive balls 74 when desired. Normally the balls 74 reside within laterally disposed openings 76 formed through the walls of projecting portion 58, the openings or passageways having rounded portions 78 at the exterior thereof to keep a majority portion of the balls 74 from protruding therefrom. Retaining clip 80 snaps into groove 82 on central portion 56 and washers 84 and 86 having an aperture slightly larger than central portion 56 and a diameter greater than flange 54 can be positioned between clip 80 and flange portion 54.

In actual operation and after the assembly 12 is firmly attached to the musical instrument 16 by means of screw 52, the pin member 14 is attached to the harness or strap 22 by removing ring 80 and washer 86, placing the slit portion 88 of the harness 22 over central portion 56 adjacent washer 84, replacing washer 86 and snapping clip 80 back into groove 82. The harness thus fits intermediate washers 84 and 86 and clip 80 and stays in place as long as desired. The width of the washers 84 and 86 is such that when strap 22 is in place, most of the space between flange 54 and clip 80 is occupied.

To secure the harness 22 to the musical instrument 16 requires the insertion of the pin member 14 into the assembly 12. This is accomplished by gripping the pin member 14 with several fingers under the washer 86 or clip 80 and then with the thumb of the same hand depressing button 66 until it is flush with flange 54, thereby positioning ball socket 72 opposite passageways 76 so balls 74 can enter therein as projecting portion 58 enters annular chamber 44. When the bottom 89 of central portion 56 abuts top surface 32, the balls 74 are opposite interior annular groove 48 and enter therein when button 66 is no longer depressed and finger 68 forces balls 74 to protrude from the projecting portion 58 into the corresponding interior annular groove 48.

A large enough portion of the balls 74 extend into the groove 48 so that pin member 14 cannot be separated from assembly 12 by accident. To disengage pin member 14 from assembly 12, simply depress button 66 and pull the pin member 14 away from assembly 12. This is possible because the balls 74 can go back into ball socket 72 when button 66 is depressed. If desired, a cam lever, pull ring or other structure may be attached to button 66 to assist in moving it against spring 70.

Thus, it can be seen that the device for securing a harness to a musical instrument of the present invention provides positive locking engagement, has a quick release, contains no loose parts, has no sharp wearing edges and is suitable for one handed operation. Additionally, the projecting portion 58 can rotate within the chamber 44 while engaged therein, thereby allowing the harness 22 to swivel with respect to the musical instrument 16, thus eliminating any chance of harness 22 becoming twisted because of the gyrations of the player 26.

It will be obvious that numerous modifications and variations are possible for the above described device within the scope of the present invention. The foregoing description, as setting forth various constructional and operational details for purposes of understanding only, is not to be taken as limiting the scope of the present invention which is defined only by the following claims.

We claim:

1. A device for removably securing a harness to a musical instrument, comprising:

a receptacle assembly having a chamber therein and attached to a musical instrument, a pin member having a projecting portion, a flange and a retaining clip, two enlarged members between said flange and said retaining clip, a harness attached to said pin member intermediate said enlarged members, and means for selectively engaging said projecting portion within said chamber and allowing for rotatable movement therebetween.

2. The device of claim 1 wherein the engaging means includes an interior annular groove within said chamber, an axially disposed cavity within said projecting portion, a plurality of laterally disposed openings formed through the walls of said projecting portion, and a plurality of balls movable within said openings and adapted to engage said annular groove.

3. The device of claim 2 wherein means movable within said cavity normally retains said balls in engagement with said annular groove.

4. A method of removably securing a harness to a musical instrument, comprising:

positioning an enlarged member adjacent the flange portion of a pin member, inserting the pin member through an aperture of the harness, positioning another enlarged member on the other side of the harness, sliding a retaining clip into a groove on the pin member, and engaging the pin member within a receptacle assembly attached to a musical instrument.

* * * * *